US008047972B1

(12) United States Patent
Dean et al.

(10) Patent No.: US 8,047,972 B1
(45) Date of Patent: Nov. 1, 2011

(54) EASILY ADJUSTABLE AND LOCKABLE EXERCISE BAR APPARATUS

(76) Inventors: Randy Theodore Dean, San Francisco, CA (US); Robert Roland LeRoy, Forestville, CA (US)

( * ) Notice: Subject to any disclaimer, the term of this patent is extended or adjusted under 35 U.S.C. 154(b) by 0 days.

(21) Appl. No.: 12/905,683

(22) Filed: Oct. 15, 2010

(51) Int. Cl.
*A63B 21/078* (2006.01)

(52) U.S. Cl. ..... 482/104; 482/98; 482/101

(58) Field of Classification Search ..... 482/17, 482/38–43, 92, 93, 97–104, 904, 131–137, 482/139
See application file for complete search history.

(56) References Cited

U.S. PATENT DOCUMENTS 2,688,289 A 9/1954 Sterling
3,642,278 A 2/1972 Hinckley
5,389,055 A 2/1995 Gangloff
5,738,615 A * 4/1998 McCollum et al. ..... 482/108
5,765,978 A 6/1998 Looker et al.
6,623,409 B1 9/2003 Abelbeck
7,455,629 B2 * 11/2008 Abelbeck ..... 482/92

* cited by examiner

*Primary Examiner* — Stephen Crow
*Assistant Examiner* — Daniel Roland
(74) *Attorney, Agent, or Firm* — David Pressman

(57) ABSTRACT

An adjustable exercise bar comprises a bar (145) and one or more rails (100, 105) upon which one or more bar retainers are constrained to move. The rails are secured to a vertical surface such as a wall or post (110). A plunger assembly (400) contained within the bar retainers is coupled to the bar by a stiff metal band that is attached to the bar. A plunger in each plunger assembly is normally inserted in a hole (115) in the rail or rails, preventing the bar retainer from moving. The plunger assembly is actuated by rotating the front of the bar upward (from the user's perspective). This actuation causes the plunger (405) to be removed from the hole, enabling movement of the bar upward or downward. When the rotational force on the bar is removed, a spring (435) within the plunger assembly returns the bar to its original rotational position and returns the plunger to a hole in the rail. An optional weight (155) secured to the bar retainers by cords (160, 161) acts as a counterbalance to bar movement. An additional static bar (170) is provided to permit the performance of additional exercises.

20 Claims, 3 Drawing Sheets

EASILY ADJUSTABLE AND LOCKABLE EXERCISE BAR APPARATUS

BACKGROUND

1. Prior Art—Exercise Bars

Humans have long used exercise bars for stretching, strengthening, and toning many parts of their bodies. In general, they comprise a horizontal bar that is movably held at a predetermined height. The user grips the bar with one or both hands and bears against it from various angles, providing resistance to muscular efforts. Alternatively, the bar can be used to restrain the user's feet for use in leg, foot, back, and stomach exercises. Accessories to the bar, such as balls and benches, permit the user to attain additional postures for exercise. The height of the bar is normally adjustable to accommodate users of various sizes and to permit a variety of exercises to be performed.

The following is a list of some prior art that shows such bars.

| U.S. Pat. No. or Pub. Nr. | Kind Code | Issue or Pub. Date | Patentee or Applicant |
|---|---|---|---|
| 2,688,289 | B1 | Sep. 07, 1954 | Sterling |
| 3,642,278 | B1 | Feb. 15, 1972 | Hinckley |
| 5,389,055 | B1 | Feb. 14, 1995 | Gangloff |
| 5,765,978 | B1 | Jun. 16, 1998 | Looker et al. |
| 6,623,409 | B1 | Sep. 23, 2003 | Abelbeck |

Hinckley shows an adjustable floor and ceiling supported chinning bar. A bar is suspended at its ends by a pair of threaded C-clamps that are secured to foraminous vertical supports by wing nuts. The upper and lower ends of the supports are respectively springably wedged between a ceiling and floor. The vertical position of the bar is adjusted by removing the wing nuts, relocating the clamps, and replacing the wing nuts. While this apparatus is useful, adjusting the height of the bar for a series of different exercises or for different users is onerous.

Gangloff teaches a portable exercise bar device comprising a horizontal bar and pair of vertical bar supports that are secured to a flat base. In one embodiment, the supports include a plurality of holes that accept movable pins that project from the ends of the horizontal bar. In another embodiment, pins that extend from the horizontal bar slidably fit into notches in the vertical supports. This device is limited to providing support for performing pull-ups while the user is in a supine position. It must be partially disassembled when it is to be moved.

Looker et al. show a cargo track fitting with a springably liftable plunger that normally engages circular cut-outs in the track when the fitting is secured, but releases from the track when the plunger is lifted. This device is easily repositioned along the track by simply lifting the plunger. Lifting the plunger also permits removal of the device from the track. This ability is not desirable in uses where removal of the device from the track is not wanted.

Abelbeck shows an automatic locking exercise device comprising a horizontal exercise bar that is constrained to move up and down in a pair of vertical tracks. The vertical tracks each include a ratchet. The bar is rotatably coupled to a pair of spring-loaded pawls that slidably move over the ratchets when the bar is moved upward, but normally prevent the bar from moving downward. To move the bar downward, the user rotates the bar, releasing the pawls from contact with the ratchets and allowing the bar to slide downward. While it is useful in preventing weights from falling, for example, the ratchet-and-pawl component of this device limits its use to one-way vertical exercises.

2. Prior Art—Tie-Down Fittings

The ends of the above exercise bars are generally secured to vertical support members by locking devices that move slidably within channels. Such locking devices are also found in tie-down anchoring devices like those used in cargo holds of aircraft, ships, and trucks.

Sterling shows a tie-down assembly comprising a ring and clamp device that slidably moves in a channel in a released condition, and when actuated securely grips the channel. A ring that extends from the clamp is used to secure a rope that holds the cargo in place. This device provides a secure grip, but clamping and release operations would be cumbersome if the device were to be incorporated into an exercise bar that is to be moved frequently.

While the above-described devices are each useful for their intended purposes, they are not suitable for use in an exercise apparatus of the type described below.

SUMMARY

We have discovered a new apparatus that supports and secures a movable exercise bar during use, yet permits easier relocation of the bar to a new and secure vertical position. Our device comprises one or more foraminous vertical rails that are secured to a vertical support such as a wall or stand. One or more vertically movable bar supports includes a channel that constrains the support to move along a rail. Each bar support also contains a spring-loaded plunger having a first end that can be removably inserted into any hole in the vertical rails in order to secure the bar at a predetermined height. A plunger actuating arm is located within each bar support. One end of the actuating arm is secured to the bar and the other is secured to the opposite end of the plunger. When it is desired to relocate the bar, the bar is rotated within the support, thereby actuating the plunger and removing it from the hole in the rail and releasing the bar support, allowing the bar to be moved up or down. When the bar is at the desired height, the rotational torque is released from the bar and the plunger is springably urged into a new hole in the rail, whereupon the bar is again secured at the new height.

DRAWING FIGURES

DRAWING FIGURE REFERENCE NUMERALS

100 Rail
101 Recess

Figure 3:
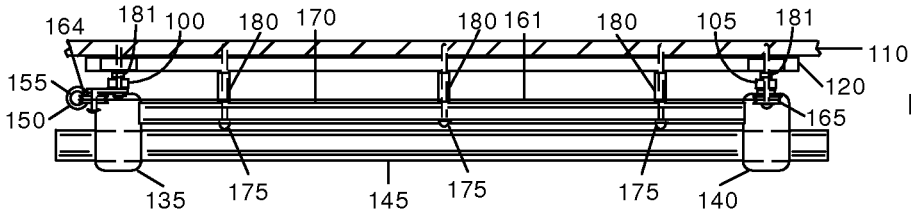
FIGS. 1 through 3 show front and side elevation views and a top plan view, respectively, of one aspect of one embodiment of our apparatus.
Figure 1:
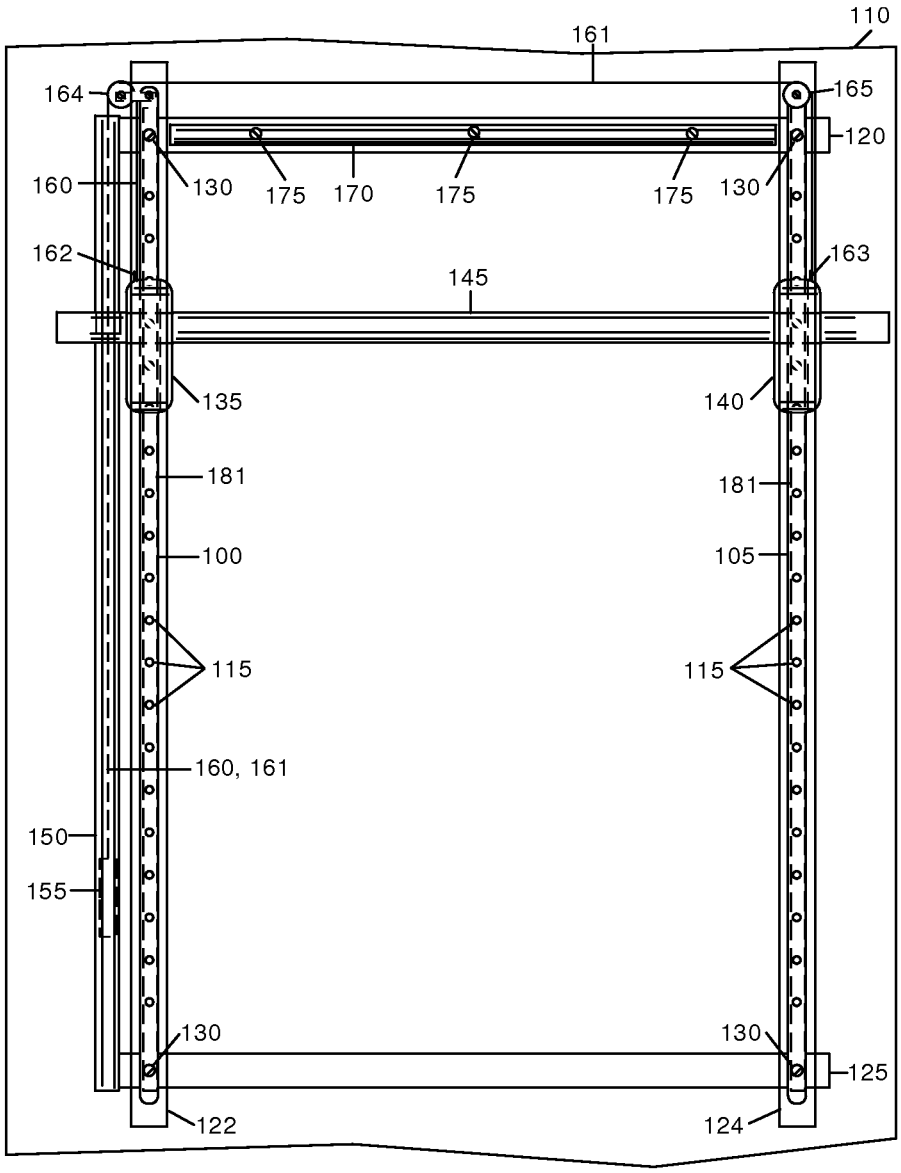
Figure 2:
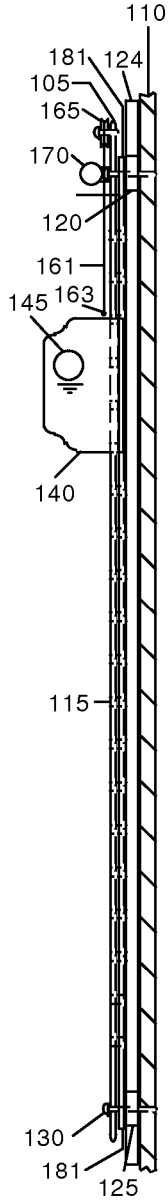

103 Bracket
105 Rail
110 Surface
120 Brace
122 Brace
124 Brace
125 Brace
130 Fastener
115 Hole
133 Cavity
135 Bar retainer
140 Bar retainer
145 Bar
150 Tube
155 Weight
160 Cord
161 Cord
162 Attachment
163 Attachment
164 Pulley
165 Pulley
170 Bar
175 Bolt
180 Standoff
181 Spacer
400 Plunger assembly
405 Plunger
410 Threads
415 Shell
420 Grooves
425 Threads
430 Washer
435 Spring
440 Cap
445 Nut
500 Bore
505 Bore
510 Band, Lever, or Blade
515 Fastener
520 Arrow
525 Hole
530 Screw
535 Roller
540 Roller
900 Fastener
905 Bore
1100 Screw body
1105 Head
1110 Hole
1115 Nut First Embodiment Description—FIGS. 1-3—Overview FIGS. 1 through 3 show front, side, and plan views of one aspect of one embodiment. A pair of rails 100, 105 are securely attached to a vertical surface 110. Surface 110 can be a wall, a board, or a pair of posts (not shown). Rails 100 and 105 each contain a plurality of holes 115 that are spaced at the same intervals. The uppermost hole 115 in rail 100 is at the same vertical datum as the uppermost hole 115 in rail 105 so that each hole in rail 100 has a corresponding hole at the same datum in rail 105. Alternatively, instead of regular intervals, holes 115 can be spaced at different intervals at different heights on rails 100, 105. The only requirement is that each hole in rail 100 have a corresponding hole in rail 105 at the same vertical datum.

Figure 6:
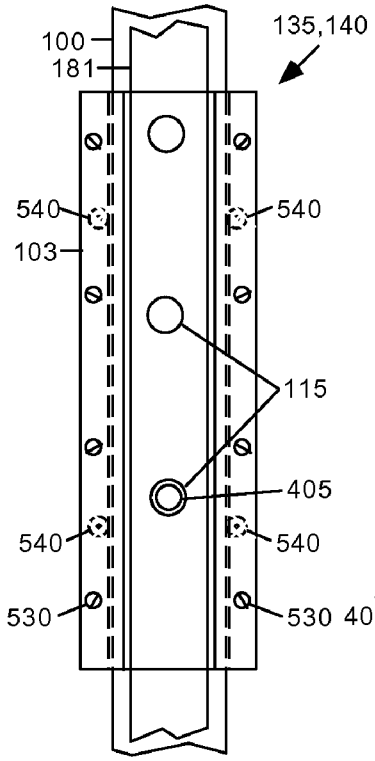

Rails 100 and 105 are attached to upper and lower horizontal braces 120 and 125, and vertical braces 122 and 124, respectively, by fasteners 130. Rails 100 and 105 are spaced from braces 120-125 by spacer bars 181 (FIGS. 2 and 6). Holes 115 collinearly pass through both rails 100 and spacer bars 181. While providing spacing between rails 100 and 105 and braces 120-125, spacer bars 181 also add strength to that provided by rails 100 and 105. In turn, braces 120, 122, 124, and 125 are securely affixed to wall 110 or other vertical support.

A pair of bar retainers 135 and 140 are constrained to move up or down on rails 100 and 105, respectively. Rails 100 and 105 move within recesses in retainers 135 and 140, respectively; the recess 101 in retainer 135 is shown in FIGS. 5, 7, 8, and 9. Rails 100 and 105 are prevented from disengaging from recess 101 and the recess (not shown) in retainer 140 by a pair of brackets 103 (FIGS. 5, 7, and 8) on each retainer. Brackets 103 are secured to the bar retainers by a plurality of screws 530 (FIGS. 5-8). Retainers 135 and 140 (FIGS. 1 to 3) each have an internal spring-loaded plunger mechanism, described below, that inserts a plunger into one of holes 115 in order to hold retainers 135 and 140 at a predetermined height. Retainers 135 and 140 retain and support a bar 145. Bar 145 can be rotated in retainers 135 and 140, but is not normally removable. Bar retainers 135 and 140 are not drawn to scale. The depths of the front and rear sections of the bar retainer are approximately equal to one another.

A vertical tube 150 adjacent rail 100 conceals and protects a weight 155 that moves slidably therewithin. Weight 155 is suspended by a pair of cords 160, 161 that exit tube 150 at the top. Cord 160 passes over a pulley 164 then is attached to retainer 135 by an adjustable attachment 162. Cord 161 passes over pulley 164 and a second pulley 165 and then is attached to retainer 140 by an adjustable attachment 163. Instead of a single pulley 164, a plurality of pulleys can be used to guide cords 160 and 161 into tube 150.

Figure 11:
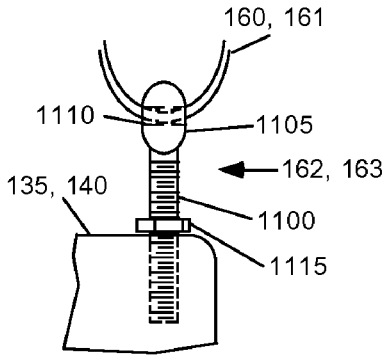
FIG. 11 is a side view of an adjustable cord retainer according to one aspect of one embodiment.

Attachments 162 and 163 are shown in more detail in FIG. 11. Each comprises a screw body 1100 and a fixed head 1105 with a hole 1110 through which one of cords 160, 161 is passed and secured. After attachment of weight 155 to the distal end of cords 160 and 161 and the securing of the proximate ends to attachments 162 and 163, attachments 162 and 163 are adjustably threaded into bar retainers 135 and 140 until bar 145 is level. When this is done, nuts 1115 on attachments 162 and 163 are tightened against retainers 135 and 140, thereby securing cords 160 and 161.

Weight 155 is a counterbalance for the combined weights of retainers 135 and 140 and bar 145. While weight 155 can optionally be omitted, it is useful because it reduces the amount of force required to move bar 145 upward and contributes to the smoothness of travel as retainers 135 and 140 are moved up and down.

A second, fixed bar 170 is rigidly attached to brace 120 by three a bolts 175. Three standoffs 180 (FIG. 3) secure bar 170 away from brace 120 to permit a user to wrap their hands or cords around it for performing additional exercises.

Rails 100 and 105 are made of a strong material such as a metal, a reinforced plastic, or hard wood. Bars 145 and 170 and braces 120 and 125 are preferably made of wood, but can also be made of a metal or reinforced plastic. Retainers 135 and 140 are preferably made of wood or a reinforced plastic. Weight 155 can be any material of suitable density to fit into tube 150 and counterbalance retainers 135 and 140 and bar 145. Tube 150 can be plastic or metal. Cords 160 and 161 are preferably made of vinyl-coated, woven steel, although other materials can be used. Rails 100 and 105 are preferably between 1 and 2 meters long, 3.8 cm wide, and 6.3 mm thick, although other sizes can be used. The diameter of bars 145 and 170 are preferably 6.3 and 5.1 cm, although other sizes can be used. The remaining dimensions in FIGS. 1 through 3 scale approximately as shown.

Bar Retainers—FIGS. 4 through 7

Figure 4:
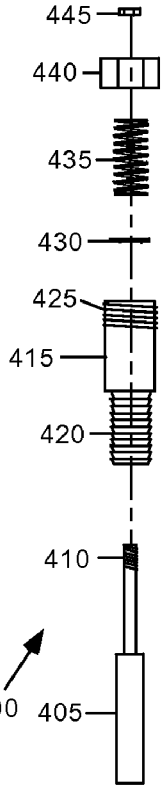
FIG. 4 shows an exploded view of one aspect of a plunger assembly used in our apparatus.
Figure 8:
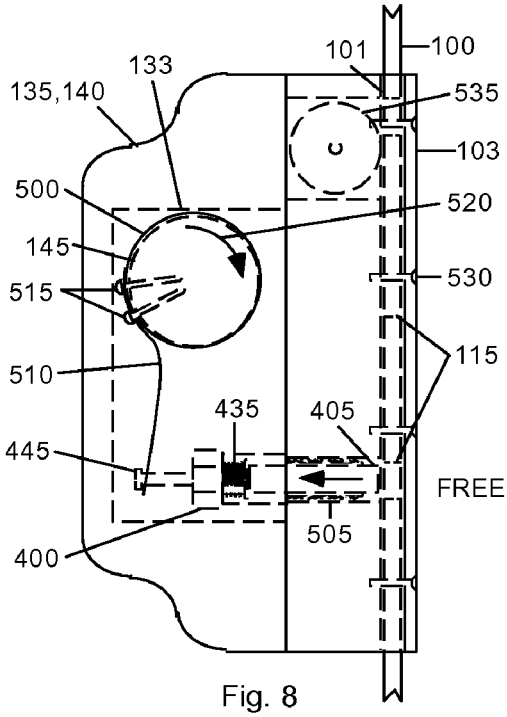
FIG. 8 is the same as FIG. 5 except the plunger assembly is actuated.

Bar retainers 135 and 140 each comprise a housing that contains a spring-loaded plunger assembly. FIG. 4 shows an exploded view of a spring-loaded plunger assembly indicated at 400. Assembly 400 comprises a plunger 405 having threads 410 at the upper end. Plunger 405 slidably moves within a shell 415 that has a plurality of grooves 420 at the lower end and threads 425 at the upper end. A washer 430 permits plunger 405 to bear against a compression spring 435. Upon assembly, a threaded cap 440 mates with threads 425 on shell 415 and a nut 445 secures plunger 405 within shell 415. When assembled, plunger assembly 400 appears as shown in FIGS. 5, 7, 8, and 9. Urging nut 445 axially away from shell 415 draws plunger 405 into shell 415 while compressing spring 435. When nut 445 is released, spring 435 pushes plunger 405 back out to its original position.

Figure 7:
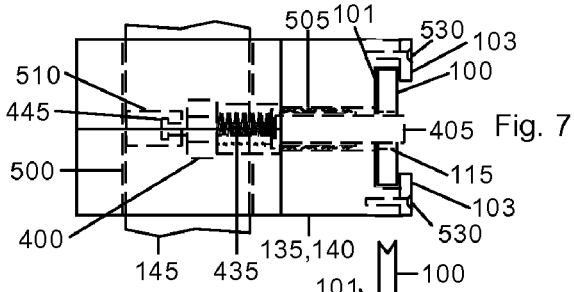
FIGS. 5 through 7 show side, bottom, and end views respectively of a bar retainer component of our apparatus with a plunger assembly in a not-actuated condition.
Figure 5:
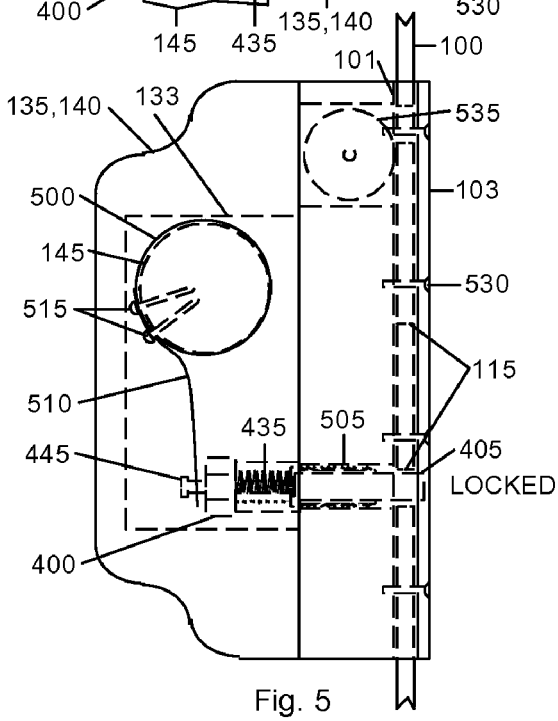

FIGS. 5 through 7 show side, bottom, and end views, respectively, of retainers 135 and 140. Since they are identical, only retainer 135 will be discussed in detail. Retainer 135 has been mounted on bar 100 and is ready for use. Retainer 135 includes an internal cavity 133 to allow room for placement and movement of all internal components. Retainer 135 also includes a bore 500 within which bar 145 is rotatably secured.

Plunger assembly 400 is also secured within retainer 135. Grooves 420 of plunger assembly 400 are preferably inserted into a bore 505 with a slidable, friction fit and glued in place. Plunger assembly 400 is positioned so that plunger 405 extends outward from retainer 135 and engages one of holes 115 in bar 100 when spring 435 is in its extended, relaxed state. When plunger 405 is axially withdrawn into shell 415, plunger 405 is fully disengaged from bore 115 in bar 100.

A contoured, stiff band, lever, or blade 510 is secured to bar 145 with two fasteners 515 at one end and the threaded, upper end of plunger 405 at the other end. Lever 510 can be secured within a notched region on bar 145, or simply contoured to fit bar 145 as shown. Lever 510 is preferably made of a stiff metal, such as steel, so that it will not bend appreciably during use.

Optional rollers 535 (FIGS. 5 and 8) and 540 (FIG. 6) can be included to facilitate smooth motion of retainers 135 and 140 on rails 100 and 105. Rollers 535 ride on the front surface of rail 100, while rollers 540 ride on the sides of rail 100.

During normal use, retainers 135 and 140 are fixedly secured to a pair of holes 115 in bars 100 and 105 by plungers 405. This condition, in which bar 145 is locked in place, is shown in FIG. 5. When it is desired to raise or lower bar 145 the user (not shown) manually rotates bar 145 in the clockwise direction indicated by arrow 520 in FIG. 8. This rotation causes lever 510 to also rotate, urging plunger 405 within both of retainers 135 and 140 to move axially within plunger assembly 400 and compressing spring 435. In this position, plunger 405 is pulled out of and is no longer engaged with any of holes 115 and retainers 135 and 140 are both free to move upward or downward along rails 100 and 105, respectively.

When bar 145 is at or near the desired height, the user releases their rotational grip on it, allowing spring 435 to expand and reverse the previous rotation of bar 145 and band 510. When plunger 405 is over one of holes 115, it will be springably urged into hole 115 by spring 435. If the user's rotational grip on bar 145 is released when plunger 405 is not adjacent one of holes 115, retainers 135 and 140 can be moved up or down until plunger 405 is adjacent one of holes 115, at which point spring 435 will urge plunger 405 into hole 115 and both retainers will be locked in place.

Figure 9:
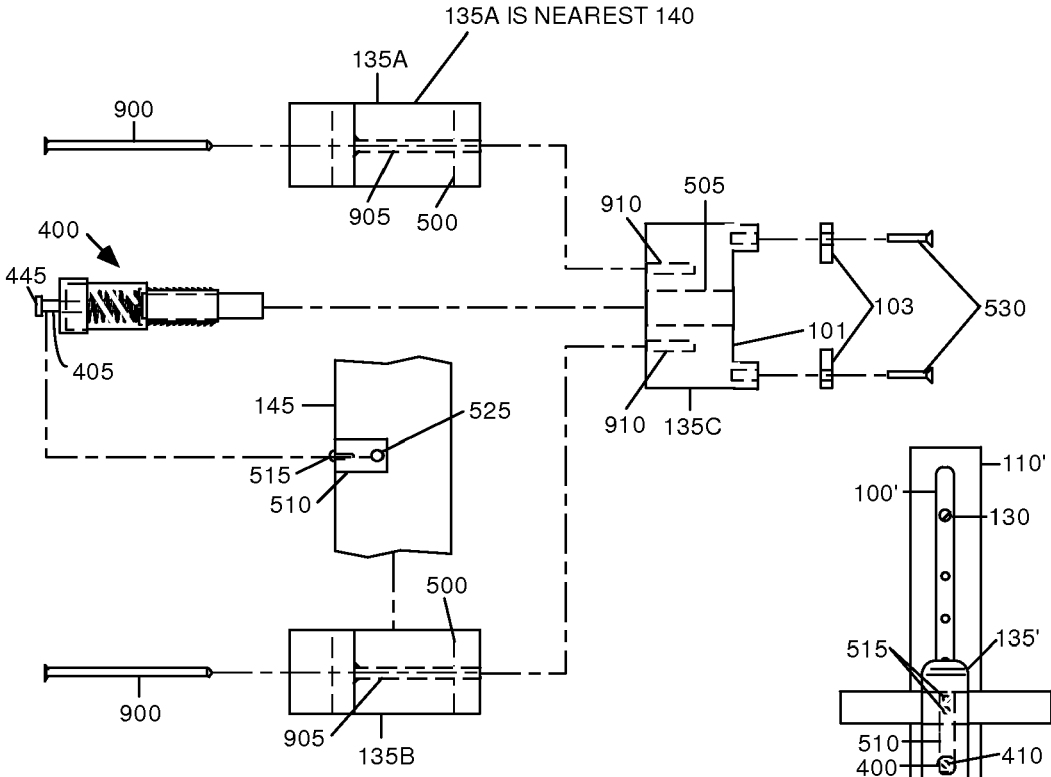
FIG. 9 is an exploded view used in showing the steps of a bar retainer.

First Embodiment Assembly—FIG. 9

As above, both retainers are identical and retainer 135 will be used as an example for both retainers 135 and 140. FIG. 9 shows an exploded, end view of retainer 135. In the present aspect of this embodiment, the housing of retainer 135 comprises three principal parts, two side pieces 135A and 135B, and a third piece 135C to which both side pieces are attached.

Prior to assembly, cavity 133 (FIG. 8) has been formed and all holes have been bored and threaded as required. Assembly of retainer 135 proceeds as follows: (1) Grooves 420 (FIG. 4) of plunger assembly 400 are coated with a layer of glue such as epoxy. (2) Plunger assembly 400 is inserted a predetermined depth into bore 505 (FIG. 9). This depth is such that when plunger 405 is fully extended from plunger assembly 400 it will just pass through bar 100 (FIG. 5). (3) Bore 500 in side piece 135A is slidably moved over one end of bar 145 to a distance of about 30 cm. (4) Two fasteners 515 are used to securely attach lever 510 to bar 145 at a distance of about 20 cm from the end of bar 145. Shorter or longer distances can be used, depending upon the length of bar 145 and the desired distance between rails 100 and 105. (5) Lever 510 includes a hole 525 that is sized to slidably encircle the threaded end of plunger 405. Nut 445 is temporarily removed, hole 525 is slid over the threaded end of plunger 405, and nut 445 is securely and tightly replaced on plunger 405. (6) Sides 135A and 135B are slidably moved together on bar 145 with their inner, touching surfaces located adjacent fasteners 515 and hole 525. Because of the attachment of plunger 405 to lever 510, piece 135C of retainer 135 will be adjacent sides 135A and 135B at this time. (7) Fasteners 900 are inserted into bores 905 and tightly threaded into holes 910 in piece 135C. This completes the installation of bar 145 into retainer 135. (8) Next, retainer 135 is placed on rails 100 and 105 so that the rails rest in recess 101. Brackets 103 are then affixed to piece 135 with a plurality of fasteners A similar process is followed to install bar 145 into retainer 140.

Figure 10:
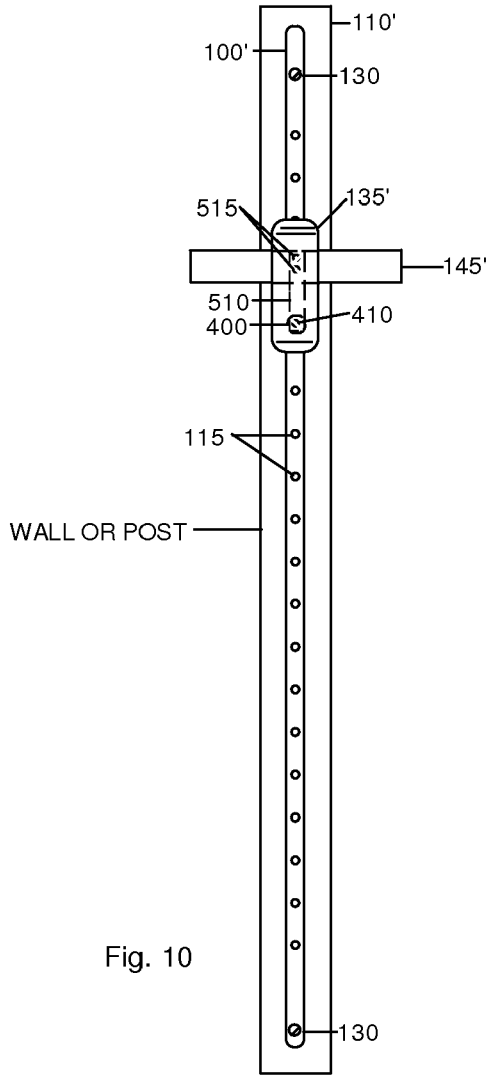
FIG. 10 is a frontal view of an alternative embodiment of our exercise apparatus.

Alternative Embodiment—Single Rail and Retainer—FIG. 10

FIG. 10 shows a front elevation view of one aspect of an alternative embodiment. Instead of two bar retainers and rails, a single bar retainer 135' slidably moves along a rail 100' and locks in place in one of holes 115'. Retainer 135' and its internal components are similar in all respects to retainer 135. This embodiment is useful when a user wishes to grip the ends of bar 145' with both hands during the performance of various exercises.

CONCLUSIONS, RAMIFICATIONS, SCOPE

We have provided an improved exercise bar with a height that is easily adjustable by the user during use. Rather than having to stop exercise in order to raise or lower a bar by removing and replacing pins, our apparatus allows the user to simply rotate the bar through a small angle, then lift or lower the bar to a new height, and release the bar where it is securely affixed to the rail at the new height.

While the above description contains many specificities, these should not be construed as limitations on the scope, but as exemplifications of some present embodiments. Many other ramifications and variations are possible within the teachings of the invention. For example, the materials and sizes can be changed, the bar release mechanisms can be varied, as can the shapes of the components. Instead of two bars, one can be used. Many of the parts can be made of alternative materials including reinforced plastics, wood, and metals of various kinds. All components can be made in one or more colors for decorative effects. Bars can be longer or shorter, as required. Instead of one or two rails, a single bar can be extended through three or more rails and retainers. Instead of being located on a vertical surface, the apparatus can be installed at various angles. Instead of a counterbalance weight, a rotary spring and wheel can be used to provide lift for the bar and retainers. Instead of separate rails and spacer bars, the two can be extruded or otherwise provided as a single unit. Instead of using spacer bars, a plurality of spacers in the form of individual cylinders can be used to support the rails.

Thus the scope should be determined by the appended claims and their legal equivalents, rather than the examples and particulars given.

The invention claimed is:

1. An adjustable, horizontal bar exercise apparatus, comprising:

a bar, first and second vertically-oriented, parallel foraminous rails, each of said rails containing a plurality of vertically disposed holes wherein at least one hole in said first rail is located at a common vertical position with at least one hole in said second rail, a pair of bar retainers, each slidably mounted on one of said rails and each having a bore through which said bar extends and within which said bar can be urged to rotate, said bar retainers further each including a springably actuated plunger assembly comprising a spring and a plunger within a housing and a lever that connects said bar to said plunger, said plungers being arranged to arrest motion of said retainers when said bar is in a first rotational position, said plungers being arranged to arrest said motion when said bar is in said first rotational position within said retainers by causing said plungers to extend from said housing and from said retainers into respective vertically disposed holes in said rails so that said plungers extend into said respective holes to lock said retainers and said bar on said rails to prevent said retainers and said bar from moving up or down on said rails, and said lever being arranged so that when said bar is urged to rotate to a second rotational position, said lever also rotates and urges said plunger to withdraw from said vertically disposed holes in said rails, thereby permitting said retainers to move on said rails, whereby when said bar is in said first rotational position it is fixed at a first vertical position, and when said bar is in said second rotational position, it is free to move to a new vertical position.

2. The apparatus of claim 1, further including:

a weight, a pair of cords, a first of said cords connecting said weight to a first of said bar retainers and a second of said cords connecting said weight to a second of said bar retainers, said weight being arranged to counterbalance said bar and said bar retainers, so that when said bar is urged to rotate to said second rotational position said retainers will move smoothly and easily on said rails.

3. The apparatus of claim 2 wherein said cords are connected to said retainers by adjustable attachments, thereby ensuring leveling and smooth motion of said bar when said bar is rotated to said second rotational position.

4. The apparatus of claim 1 wherein each of said bar retainers further includes at least one roller positioned so as to bear against the front of said rails upon which it is mounted, thereby facilitating smooth motion of said retainers when said bar is in said second rotational position.

5. The apparatus of claim 1 wherein each of said bar retainers further includes at least one pair of rollers positioned so as to bear against the sides of said rails upon which it is mounted, thereby facilitating smooth motion of said retainers when said bar is in said second rotational position.

6. The apparatus of claim 1, further including a second, spatially fixed bar mounted on said rails parallel to said bar mounted movably in said bar retainers, whereby said fixed bar and said movably mounted bar can be used together to provide additional exercise options.

7. The apparatus of claim 1 wherein said bar, said rails, and said retainers are made of materials selected from the group consisting of metal, wood, and reinforced plastic.

8. The apparatus of claim 1, further including a plurality of braces, said braces being securable to a generally vertical, immovable surface, said rails being secured to said braces.

9. The apparatus of claim 1, further including:

a weight, a pair of cords, a first of said cords connecting said weight to a first of said bar retainers and a second of said cords connecting said weight to a second of said bar retainers, said weight being arranged to be a counterbalance to said bar and said bar retainers, so that when said bar is urged to rotate to said second rotational position said retainers will move smoothly and easily on said rails, and each of said bar retainers further including at least one roller positioned so as to bear against the front of said rails upon which it is mounted, thereby facilitating smooth motion of said retainers when said bar is in said second rotational position.

10. An adjustable, horizontal bar exercise apparatus, comprising:

a bar, a vertically-oriented rail containing a plurality of vertically aligned holes, a bar retainer slidably mounted on said rail and having a bore through which said bar extends and within which said bar can be urged to rotate, said bar retainer further including a springably actuated plunger assembly comprising a spring and a plunger within a housing and a lever that connects said bar to said plunger, said plunger being arranged to arrest motion of said retainer when said bar is in a first rotational position by causing said plunger to reside in one of said holes so that said plunger extends into said hole to lock said retainer and said bar on said rail to prevent said retainer and said bar from moving up or down on said rail, and wherein when said bar is urged to rotate to a second rotational position, said lever also rotates and urges said plunger to withdraw from said one of said holes, permitting said retainer to move along said rail, whereby when said bar is in said first rotational position said bar is fixed at a first vertical position, and when said bar is in said second rotational position, it is free to move to a new vertical position where it will be secured when said bar is returned to said first rotational position.

11. The apparatus of claim 10 wherein said spring is arranged to urge said plunger into one of said holes while also urging said bar to assume said first rotational position, whereby when said bar is not otherwise urged to assume said second rotational position, said bar will assume said first rotational position and remain secured at the vertical position associated with said one of said holes.

12. The apparatus of claim 10 wherein each of said bar retainers further includes at least one roller positioned so as to bear against the front of said rails upon which it is mounted, thereby facilitating smooth motion of said retainers when said bar is in said second rotational position.

13. The apparatus of claim 9, wherein each of said bar retainers further includes at least one pair of rollers positioned so as to bear against the sides of said rail upon which it is mounted, thereby facilitating smooth motion of said retainers when said bar is in said second rotational position.

14. The apparatus of claim 1, further including a brace, said brace being securable to a generally vertical, immovable surface, said rail being secured to said brace.

15. The apparatus of claim 9 wherein each of said bar retainers further includes at least one pair of rollers positioned so as to bear against the sides of said rail upon which it is mounted, thereby facilitating smooth motion of said retainers when said bar is in said second rotational position, and further including a brace, said brace being securable to a generally vertical, immovable surface, said rail being secured to said brace.

16. A method for performing plurality of exercises, comprising:

providing a movable horizontal bar, providing a rail secured in a vertical position, said rail including a plurality of vertically displaced holes for admitting a plunger, providing a retainer with a bore for holding said bar, said retainer being slidably secured on said rail and containing said plunger, said plunger being normally springably urged to extend from said retainer and reside within one of said holes, rotatably securing said bar within said bore in said retainer, providing a lever that is secured to said bar within said retainer and connected to said plunger so that when said bar is at a first rotational position it will cause said plunger to be inserted into a first of said holes so as to lock said bar and said retainer at a first position on said rail to prevent said retainer and said bar from moving up or down on said rail, and when said bar is at a second rotational position said plunger is removed from said one of said holes, thereby permitting said bar and said retainer to be slidably moved along said rail to a second position, whereby a user can perform a first exercise by exerting force on said bar while said bar is at said first rotational position and secured to said rail by said plunger as it extends from said retainer, and then moving said bar to a new vertical position by rotating said bar to said second rotational position, thereby removing said plunger from said hole in said rail, slidably moving said bar to said new vertical position, returning said bar to said first rotational position, thereby inserting said plunger into a second of said holes, whereupon said user can perform a second exercise by exerting force on said bar while said bar is at said second vertical position, whereby said user performs said first exercise while said bar is at said first position on said rail, then said user moves said bar to said second position on said rail and locks said bar at said second position and performs said second exercise while said bar is at said second position on said rail.

17. The method of claim 16, further including:

providing an auxiliary, fixed bar secured parallel to and above said movable horizontal bar, whereby said user can perform a first exercise using said fixed and said movable bars while said movable bar is secured at a first vertical position, then said user can move said movable bar to a new secure vertical position and can perform second exercise using said fixed and movable bars while said movable bar is at said second vertical position, and said user can perform said first and second exercises using said auxiliary bar while said movable bar is at either of said first and said second vertical positions.

18. The method of claim 16, further including providing a brace, said brace being securable to a generally vertical, immovable surface, said rail being secured to said brace.

19. The method of claim 16, further including providing a second rail secured in a vertical position and similar to said first-named rail, providing a second retainer similar to said first-named retainer and secured on said second rail, and rotatably securing said bar within said bores in said retainers.

20. The method of claim 17 wherein said vertically displaced holes in said rails have equidistant spacings.

* * * * *

UNITED STATES PATENT AND TRADEMARK OFFICE

CERTIFICATE OF CORRECTION

PATENT NO. : 8,047,972 B1
APPLICATION NO. : 12/905683
DATED : November 1, 2011
INVENTOR(S) : Randy Theodore Dean et al.

It is certified that error appears in the above-identified patent and that said Letters Patent is hereby corrected as shown below:

Col. 4, line 52, delete “a”.

Signed and Sealed this
Thirty-first Day of January, 2012

David J. Kappos

David J. Kappos
*Director of the United States Patent and Trademark Office*